US005363517A

United States Patent [19]

Botsolas

[11] Patent Number: 5,363,517

[45] Date of Patent: Nov. 15, 1994

[54] PROTECTIVE COVERS FOR P-SHAPED TRAPS AND FOR WATER SUPPLY VALVES

[75] Inventor: Christos J. Botsolas, Fla.

[73] Assignee: Carol M. Botsolas, Clearwater, Fla.

[21] Appl. No.: 180,677

[22] Filed: Jan. 13, 1994

[51] Int. Cl.[5] ..... E03C 1/00

[52] U.S. Cl. ..... 4/661; 138/157

[58] Field of Search ..... 4/418, 661, 654; 137/375; 138/157, 167, 169; 150/154, 156, 901

[56] References Cited

U.S. PATENT DOCUMENTS

| | | | |
|---|---|---|---|
| 1,771,007 | 7/1930 | Weaver | 4/418 |
| 3,732,894 | 5/1973 | Botsolas | 138/178 |
| 4,093,683 | 6/1978 | Harley | 264/25 |
| 4,139,026 | 2/1979 | Zack | 138/178 |
| 4,553,308 | 11/1985 | Botsolas | 138/157 |
| 4,669,509 | 6/1987 | Botsolas | 138/178 |
| 4,830,060 | 5/1989 | Botsolas | 137/375 |
| 4,862,528 | 9/1989 | Clarke et al. | 4/661 |
| 5,024,249 | 6/1991 | Botsolas | 138/110 |
| 5,054,513 | 10/1991 | Trueb et al. | 137/375 |
| 5,055,334 | 10/1991 | Lechuga | 150/154 X |

*Primary Examiner*—Robert M. Fetsuga
*Attorney, Agent, or Firm*—Hedman, Gibson & Costigan

[57] ABSTRACT

Protective covers for an exposed horizontally disposed P-shaped sink trap and for an exposed water supply valve for protecting a wheelchair bound person from burning when using the sink. Select embodiments of the P-shaped trap protective covers can be adjustably installed with P-shaped traps of varying size and which have been installed at varying angles, and select embodiments of the water supply valves can be installed with water supply valves of varying size.

7 Claims, 11 Drawing Sheets

PROTECTIVE COVERS FOR P-SHAPED TRAPS AND FOR WATER SUPPLY VALVES

FIELD OF THE INVENTION

This invention relates to protective covers for sink P-shaped traps and water supply valves to prevent undesired contact therewith by wheelchair bound persons, and in particular to such protective covers which can be easily and quickly installed and readily adapted to conform to P-shaped traps and water supply valves of a variety of different sizes and which have been installed at different angles.

BACKGROUND OF THE INVENTION

People in wheelchairs often encounter the problem of coming into contact with plumbing fixtures under sinks, in particular P-shaped traps and water supply valves. These P-shaped traps may carry scalding hot waste water draining from the sink, and the hot water supply valve similarly carries potentially scalding hot water. As a result, those persons in wheelchairs may inadvertently and perhaps unknowingly suffer burns, bruises or scrapes on their legs as a result of such undesirable and often unavoidable contact with the P-shaped trap and the water supply valves when they wheel themselves under the sink to wash.

In recognition of this problem, various governmental agencies have enacted regulations governing protection of those in wheelchairs from these problems of scalding and scraping.

Prior art devices have addressed this problem by encapsulating the P-shaped trap and the hot and cold water supply valves with insulation in order to guard against such scalding and scraping. One such protective device for the P-shaped trap is a foam urethane or sponge rubber hood type insulation that may by glued or taped in place.

Another prior art device which addresses the instant problems is a conventional two piece sculpted PVC P-shaped trap cover fitting. These prior art covers can be trimmed at the reducing end to fit various sizes and are packed with a fiberglass blanket or soft urethane foam blanket and installed with screws, tape, pop rivets and/or adhesive. These prior art covers are commercially available from Buckaroos Inc., Indianapolis, Ind., and may have adhered therein ring spacer pieces of foamed plastic pipe insulation as a means of insulation support.

In addition, a one piece molded foamed plastic prior art cover is marketed by Mesch and Associates under the trade name SKAL+GARD. The foamed plastic cover is fitted around the P-shaped trap or water supply valve via a longitudinal split in the material, and is joined after installation by twist-ties which are embedded therein. The versatility of this product is limited since it is not able to fit anything other than the exact or substantially similar shape of the part it is intended to cover. Since there have been a great many variations of P-shaped traps and water supply valves installed in the past that do not conform to the SKAL+GARD shape, the installer may have to cut and improvise this part into an unsightly multiple glued and taped cover.

U.S. Pat. No. 4,862,528 discloses an insulated trap cover which is of unitary construction and comprises a trough-shaped bottom section integrally formed with a three-sided vertical section to substantially cover the trap.

U.S. Pat. No. 5,054,513 discloses a protective system for a P-shaped trap comprised of three separate fitted pieces with longitudinal slits thereon for facile installation.

The prior art devices cited above are disadvantageous since they do not provide a universal protective cover which can be quickly and readily adapted to fit onto a variety of different sized P-shaped traps and water supply valves and which can accommodate those P-shaped traps and water supply valves which have been installed at a variety of angles.

It is therefore an object of the present invention to provide protective covers for encapsulating P-shaped traps and water supply valves in order to protect the wheelchair bound sink user from inadvertent and undesirable burns, bruises and scrapes.

It is a further object of the present invention to provide protective covers for encapsulating P-shaped traps and water supply valves which are of universal construction, and which will thereby fit onto a variety of differently sized P-shaped traps and water supply valves without alteration.

It is a further object of the present invention to provide protective covers for encapsulating P-shaped traps and water supply valves which are of universal construction, and which will thereby fit without alteration onto a variety of P-shaped traps and water supply valves which have been installed at various angles.

It is a further object of the present invention to provide protective covers for encapsulating P-shaped traps and water supply valves which act to deflect away from the pipes the legs of a wheelchair-bound user in order to eliminate undesirable burns and scrapes.

SUMMARY OF THE INVENTION

These and other objects are met by the present invention, which in one exemplary embodiment is an adjustable protective cover for an exposed horizontally disposed P-shaped sink trap for protecting a wheelchair bound person from burning when using the sink. The sink trap to be protected against is characterized by having a vertical drain pipe connected to and extending downwardly from a sink drain outlet and a horizontally disposed P-shaped trap section having a vertical front leg connected to the vertical drain pipe, an arcuate section extending rearwardly therefrom to a vertical back leg connected to an elbow, and an outlet pipe extending from the elbow. The adjustable protective sink trap cover comprises an expandable housing for substantially enclosing the P-shaped trap section, the housing being connected at a front section to a vertically disposed upper section for substantially enclosing the vertical drain pipe. The housing and the upper section are comprised of a pair of oppositely disposed substantially mirror-image portions comprising a left portion and a right portion. Each of the left and right portions comprise a partial housing portion and a partial upper section portion. The left and right portions are fabricated from a resilient thermoplastic, such as polyvinylchloride (PVC), which can be temporarily deformed and, due to its inherent resiliency, will retain through memory and seek to return to its original shape. By partially and temporarily deforming and inserting one of the left or right portions into the other left or right portion in opposed fashion and around the vertical drain pipe and the P-shaped trap section, the portions will fit snugly partially within and against each other. Accordingly, the left and right portions are rotatable about each other around an axis extending vertically through the center of the upper section, the volume of space inside the housing can be enlarged or reduced to accommodate a variety of sizes of P-shaped traps and a variety of angles of installation of P-shaped traps.

Preferably, in the adjustable protective cover of the present invention as described above, the housing has a curved front section and an open rear and is substantially wedge shaped from the front section to the rear. Each of the partial housing portions preferably comprises a curved front, a bottom, a top and a side. Each of the partial upper sections preferably comprises a curved front and a curved rear joined by a curved side formed in a C-shaped substantially cylindrical configuration. Thus, when the left and right portions are inserted into each other and around the vertical drain pipe and the P-shaped trap section, the curved fronts of the partial upper sections overlap and the curved rears of the partial upper sections overlap and thereby surround the vertical drain pipe, and the curved front sections of the partial housing portions overlap, the bottom sections of the partial housing portions overlap, and the top sections of the partial housing portions overlap and thereby substantially surround the P-shaped trap section, and the outlet pipe extends from and out of the rear opening. The rear opening can thus be enlarged or reduced and the volume of space inside the housing can be accordingly enlarged or reduced to accommodate a variety of sizes of P-shaped traps and a variety of angles of installation of P-shaped traps, and the substantially wedge-shaped housing acts to deflect the legs of the wheelchair bound person apart from each other and around the P-shaped trap so as to prevent burning or other injury.

In an alternative embodiment of the present invention, provided is a one-piece protective cover for an exposed horizontally disposed P-shaped sink trap as characterized above. The protective cover comprises a shield for substantially surrounding the P-shaped trap section, the shield having a curved front section and a left side and a right side adjoined thereto. The shield is preferably fabricated from a substantially rigid thermoplastic, but can also be made from any of various metals such as stainless steel. The cover also comprises means for attaching the shield around the P-shaped trap section. The curved front section of the shield acts to deflect the legs of the wheelchair bound person apart from each other and around the P-shaped trap so as to prevent burning or other injury. The front of the shield can be U-shaped or wedge-shaped.

In another alternative embodiment of the present invention, provided is a protective cover for an exposed horizontally disposed P-shaped sink trap which can be mounted on sink traps where the elbow and the outlet pipe are joined with the vertical back leg of the P-shaped trap section at an angle, rather than in a straight rearward formation. Referring again to the sink trap characterization described above, this alternative embodiment comprises an elbow covering section for covering the elbow and the outlet pipe, and a trap covering section for covering the vertical front leg and the arcuate section of the P-shaped trap section. The elbow covering section comprises, in assembled form, an elbow-shaped section conformed to the elbow and integrally connected at a first end thereof to a cylindrical section conformed to the outlet pipe. The elbow-shaped section comprises a flange at a second end thereof. The elbow covering section, in unassembled form, is comprised of a pair of oppositely disposed substantially mirror-image elbow covering portions comprising a left elbow covering portion and a right elbow covering portion, each of the left and right elbow covering portions comprising a partial elbow-shaped portion, a partial cylindrical portion and a partial flange portion. The left and right elbow covering portions are fabricated from a resilient thermoplastic, such as PVC, which can be temporarily deformed and, due to its inherent resiliency, will retain through memory and seek to return to its original shape. By partially and temporarily deforming and inserting one of the left or right elbow covering portions into the other left or right elbow covering portion in opposed fashion and around the elbow and outlet pipe, the portions will fit snugly partially within and against each other. Accordingly, the elbow and outlet pipe are enclosed thereby. The trap covering section comprises, in assembled form, a trough-shaped section formed integrally with an upper section, the trough-shaped section comprising a front, a back and a trough generally curved from front to back, the upper section extending from the front of the trough-shaped section, the trough-shaped section being sized to conform to the arcuate section of the P-shaped trap section. The back of the trough-shaped section comprises a flange receiving section conformed to capture therein the flange of the elbow-shaped section of the elbow covering section. The trap covering section, in unassembled form, is comprised of a pair of oppositely disposed substantially mirror-image trap covering portions comprising a left trap covering portion and a right trap covering portion, each of the left and right trap covering portions comprising a partial trough-shaped portion, a partial upper section and a partial flange receiving section. The left and right trap covering portions are likewise fabricated from a resilient thermoplastic, such as PVC, which can be temporarily deformed and, due to its inherent resiliency, will retain through memory and seek to return to its original shape. By partially and temporarily deforming and inserting one of the left or right trap covering portions into the other left or right trap covering portion in opposed fashion and around the trap and vertical pipe, the portions will fit snugly partially within and against each other. Accordingly, the flange receiving section captures the flange of the elbow covering section. As a result, the elbow covering section and the trap covering section cooperate to enclose the vertical drain pipe, the horizontally disposed P-shaped trap section, the elbow and the outlet pipe, regardless of the angle at which the elbow and the outlet pipe extend from the vertical back leg of the P-shaped trap section.

In a further alternative embodiment, provided is a one-piece protective cover for an exposed horizontally disposed P-shaped sink trap as characterized above. This embodiment comprises a substantially cylindrical upper section of C-shaped configuration, the upper section comprising a pair of upper lips extending linearly along its edges. An elbow section is integrally connected at a first end to the upper section, the elbow section comprising a shoulder at a second end. The shoulder has integrally connected thereto a substantially circular elbow lip which is integrally connected to each of the upper lips so as to form a contiguous piece. Further, the cover comprises means for joining the upper lips to each other. The cover is fabricated from a resilient thermoplastic, such as PVC, which can be temporarily deformed and, due to its inherent resiliency, will retain through memory and seek to return to its original shape. Thus, by sheathing the elbow section substantially around the vertical front leg and substantially around part of the arcuate section of the P-shaped trap, and by sheathing the upper section substantially around the vertical drain pipe, and by joining the upper lips to each other with the joining means, the curved front portion of the protective cover acts to deflect the legs of the wheelchair bound person apart from each other and around the P-shaped trap so as to prevent burning or other injury.

One exemplary embodiment of the water supply valve cover of the present invention, wherein the water supply valve has an inlet pipe extending rearwardly therefrom and an outlet pipe extending substantially vertically therefrom, comprises a substantially cup-shaped member being sized to fit around the valve, said member comprising along its circumference an integrally connected pipe fitting, the pipe fitting being substantially U-shaped with an open end facing the rear of the member and an arcuate end facing the front of the member. The pipe fitting comprises means for encasing the outlet pipe when the cover is placed on the valve. The encasing means preferably comprises a pair of openings in the U-shaped pipe fitting and a plastic beaded cable tie associated therewith.

In an additional exemplary embodiment, the protective cover for a water supply valve characterized as above comprises, in assembled form, a major cylindrical section being sized to horizontally encase the valve, a minor cylindrical section being sized to vertically encase the outlet pipe, wherein the minor cylindrical section intersects the major cylindrical section so as to form a substantially inverted T-shaped configuration. The cover further comprises an end cap being sized to fit snugly over an end of the major cylindrical section. The cover comprises, in unassembled form, a major substantially C-shaped elongated member, the major member comprising a pair oil edges, and a pair of minor substantially C-shaped members, each of said minor members being oppositely disposed along and integral connected thereto and extending therefrom each of the edges of the major member. The cover further comprises means for joining the minor members to each other, such as PVC tape. The cover is fabricated from a resilient thermoplastic, such as PVC, which can be temporarily deformed and, due to its inherent resiliency, will retain through memory and seek to return to its original shape. Thus, upon enclosing the major C-shaped member around the inlet pipe and the valve, one of the pair of oppositely disposed minor members can be partially and temporarily deformed and inserted into the other of the pair of minor members in opposed fashion, the members will fit snugly partially within and against each other, thus enclosing the outlet pipe, and the joining means can be implemented to retain the cover in place, and the end cap can be inserted thereon.

The protective covers described herein act to deflect a wheelchair-bound user's legs away from the pipes, thereby preventing undesired burns and scrapes. Insulating material is not required between the covers and the pipes, since the air resident therein provides insulating properties and since the legs are actually directed away from the pipes by the wedge shape of the covers.

DESCRIPTION OF THE PREFERRED EMBODIMENT

Figure 1:
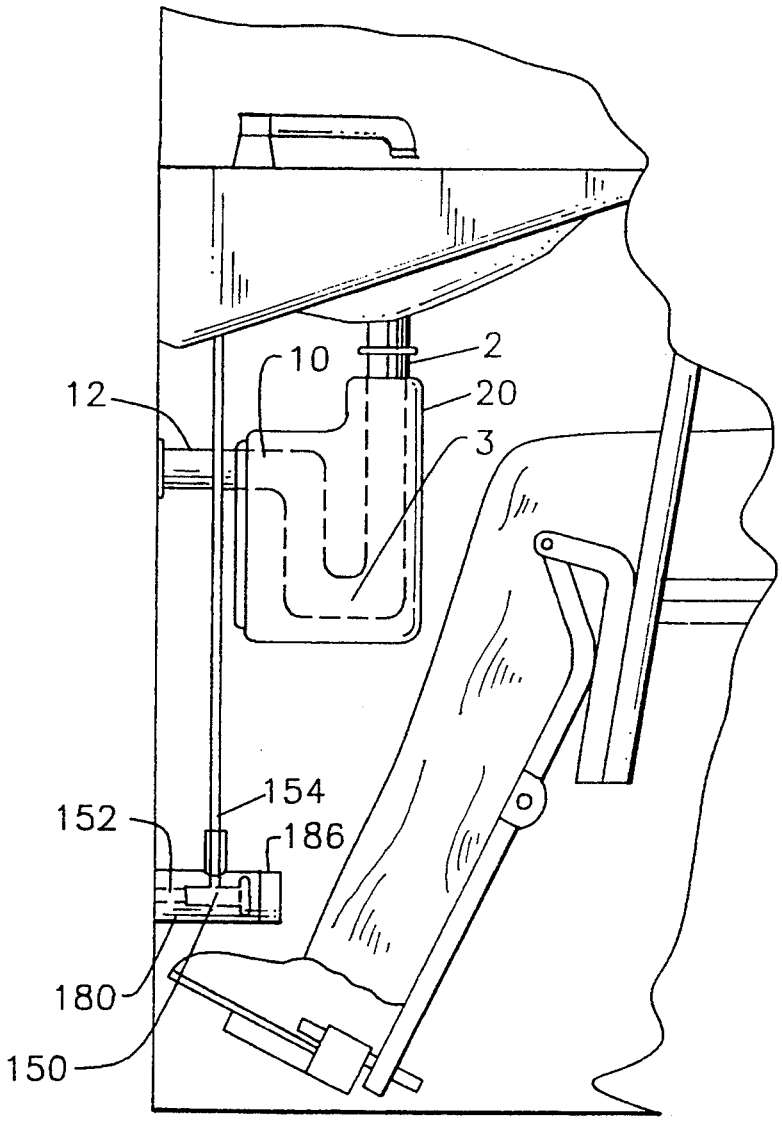
FIG. 1 is an illustration of a wheelchair bound person sitting positioned under a sink implementing a preferred embodiment of the P-shaped trap protective cover and of the water supply valve protective cover of the present invention.
Figure 2:
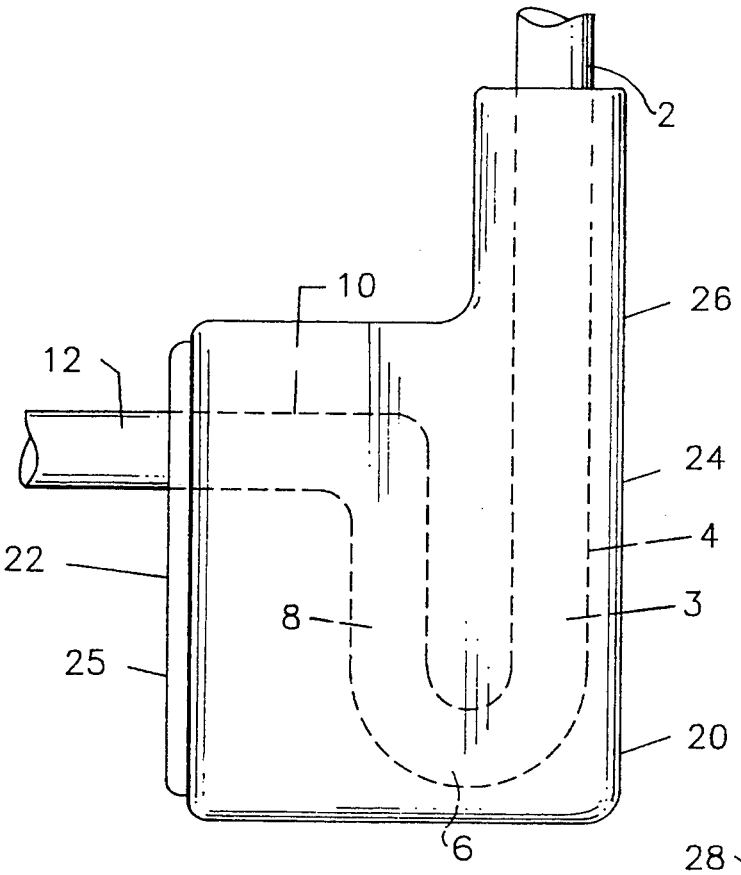
FIG. 2 is a side view of a preferred embodiment of the P-shaped trap protective cover of the present invention.

In the descriptions of the preferred embodiments of the present invention as set forth below, reference is made to a P-shaped sink trap shown in FIGS. 1 and 2 having a vertical drain pipe 2 connected to and extending downwardly from a sink drain outlet and a horizontally disposed P-shaped trap section 3 having a vertical front leg 4 connected to the vertical drain pipe 2, an arcuate section 6 extending rearwardly therefrom to a vertical back leg 8 connected to an elbow 10, and an outlet pipe 12 extending from the elbow 10.

This inventor has found, after diligent study and practice, a desired feature of all styles of P-shaped traps under sinks that would permit a cover to provide the desired protection neatly, effectively, and at low installed cost, along with removability and the ability to effect reinstallation without loss of the superiority of the fitting. The basis of the present invention is to deflect the handicapped person's legs away from harm by installing a smooth shape that insulates by air space or pipe insulation over a variety of installation configurations.

Essentially, in accordance with the present invention, a protective cover with a rounded front is placed down the front length of the vertical drain pipe 2 and the P-shaped trap section 3 to deflect both knees away from each other. If the knees proceed further in and make undesirable contact with the water supply valves, provided are various embodiments of protective covers to guard against heat and bruises from the hot water supply valve, and bruises from the cold water supply valve.

When sinks are installed, the water supply valves and water pipes are seldom in exactly the same location. Many times the P-shaped trap is offset 10° to 45° from straight back to meet the waste pipe coming out of the wall. The waste pipe and water pipes can be relatively high or low or to the left or right from one installation to another. These variations are all within the range of this preferred embodiment protective cover.

A preferred embodiment of the protective cover for the P-shaped trap is shown in FIGS. 1 through 7. Therein is shown an adjustable protective sink trap cover 20 which comprises an expandable housing 22 for substantially enclosing the P-shaped trap section 3. The expandable housing 22 is integrally connected at a curved front section 24 to a vertically disposed cylindrical upper section 26 for substantially enclosing the vertical drain pipe 2. The expandable housing 22 has an open rear 25 and is substantially wedge shaped from the curved front section 24 to the rear 25.

The expandable housing 22 and the upper section 26 are comprised of a left portion 28 and a right portion 30, which are oppositely disposed and substantially mirror-image versions of each other. Each of the left and right portions 28, 30 comprise a partial housing portion 32 and a partial upper section portion 34. Each of the partial housing portions 32 preferably comprises a curved front 36, a bottom 38, a top 40 and a side 42. Each of the partial upper sections 34 preferably comprises a curved front 44 and a curved rear 46 joined by a curved side 48 formed in a C-shaped substantially cylindrical configuration.

The left and right portions 28, 30 are fabricated from a resilient thermoplastic, such as PVC, which can be temporarily deformed and, due to its inherent resiliency, will retain through memory and seek to return to its original shape. Thus, either of the left or right portions 28, 30 can be temporarily and partially deformed to fit into the other portion. In particular, when the left and right portions 28, 30 are inserted into each other in opposed fashion and around the vertical drain pipe 2 and the P-shaped trap section 3, the curved fronts 44 of the partial upper sections 34 overlap and the curved rears 46 of the partial upper sections 34 overlap and thereby surround the vertical drain pipe 2. Likewise, the curved front sections 36 of the partial housing portions 32 overlap, the bottom sections 38 of the partial housing portions 32 overlap, and the top sections 40 of the partial housing portions 32 overlap and thereby substantially surround the P-shaped trap section 3 in conjunction with the sides 42. The outlet pipe 12 extends from and out of the rear opening 25.

Thus, by partially and temporarily deforming and inserting one of the left or right portions 28, 30 into the other left or right portion and around the vertical drain pipe 2 and the P-shaped trap section 3 such that the left and right portions 28, 30 are rotatable about each other around an axis extending vertically through the center of the upper section 26, the volume of space inside the housing 22 can be enlarged or reduced to accommodate a variety of sizes of P-shaped traps and a variety of angles of installation of P-shaped traps.

Importantly, the substantially wedge-shaped housing 22 acts to deflect the legs of the wheelchair bound person apart from each other and around the P-shaped trap so as to prevent burning or other injury.

Figure 3B:
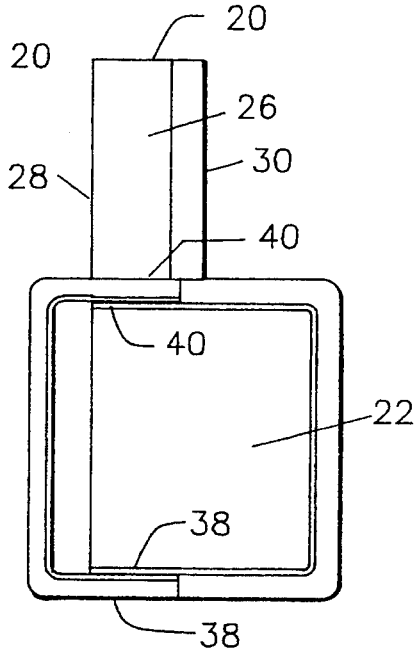
FIG. 3B is a front view of the protective cover of FIG. 2 in the expanded position.
Figure 3A:
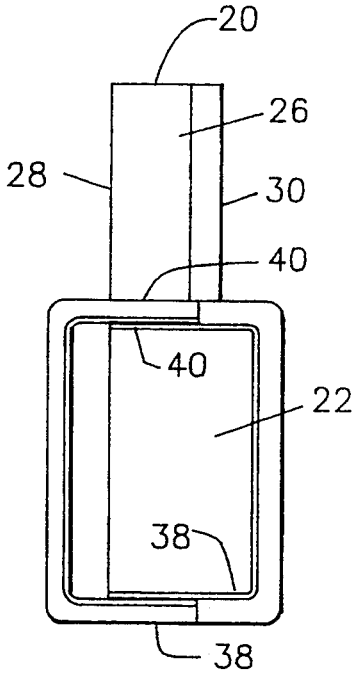
FIG. 3A is a front view of the protective cover of FIG. 2 in the non-expanded position.
Figure 4:
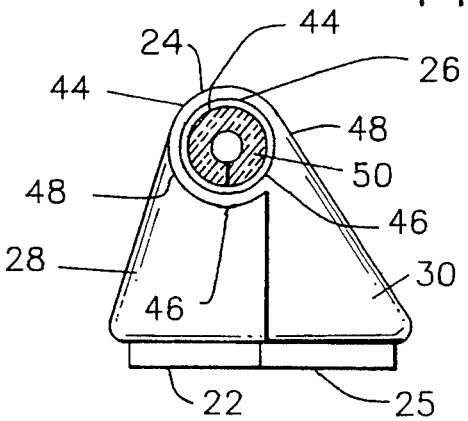
FIG. 4 is a top view of the protective cover of FIG. 2 in the expanded position.
Figure 5:
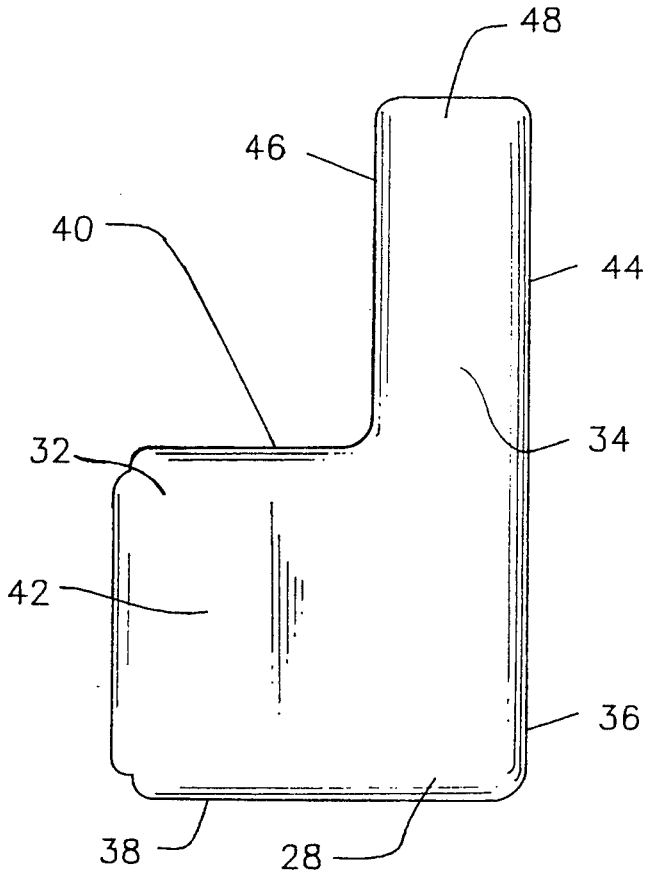
FIG. 5 is a side view of the left portion of the protective cover of FIG. 2.
Figure 6:
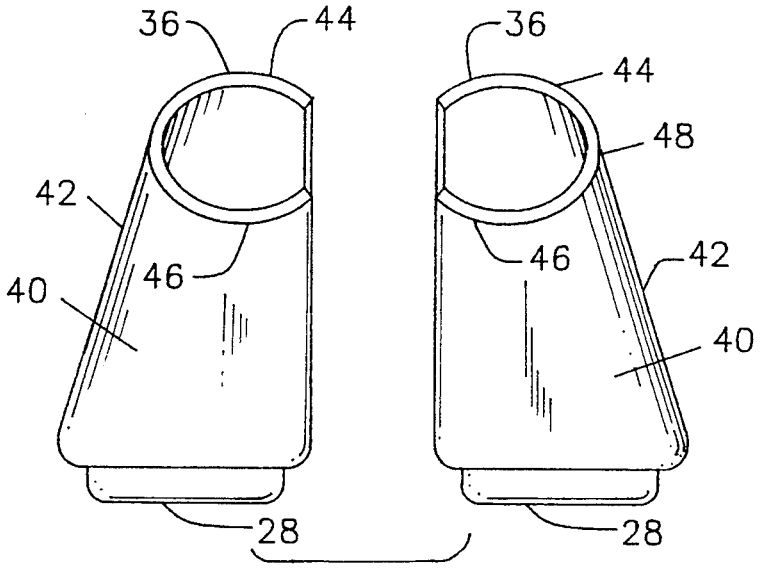
FIG. 6 is a top exploded view of the protective cover of FIG. 2.
Figure 7:
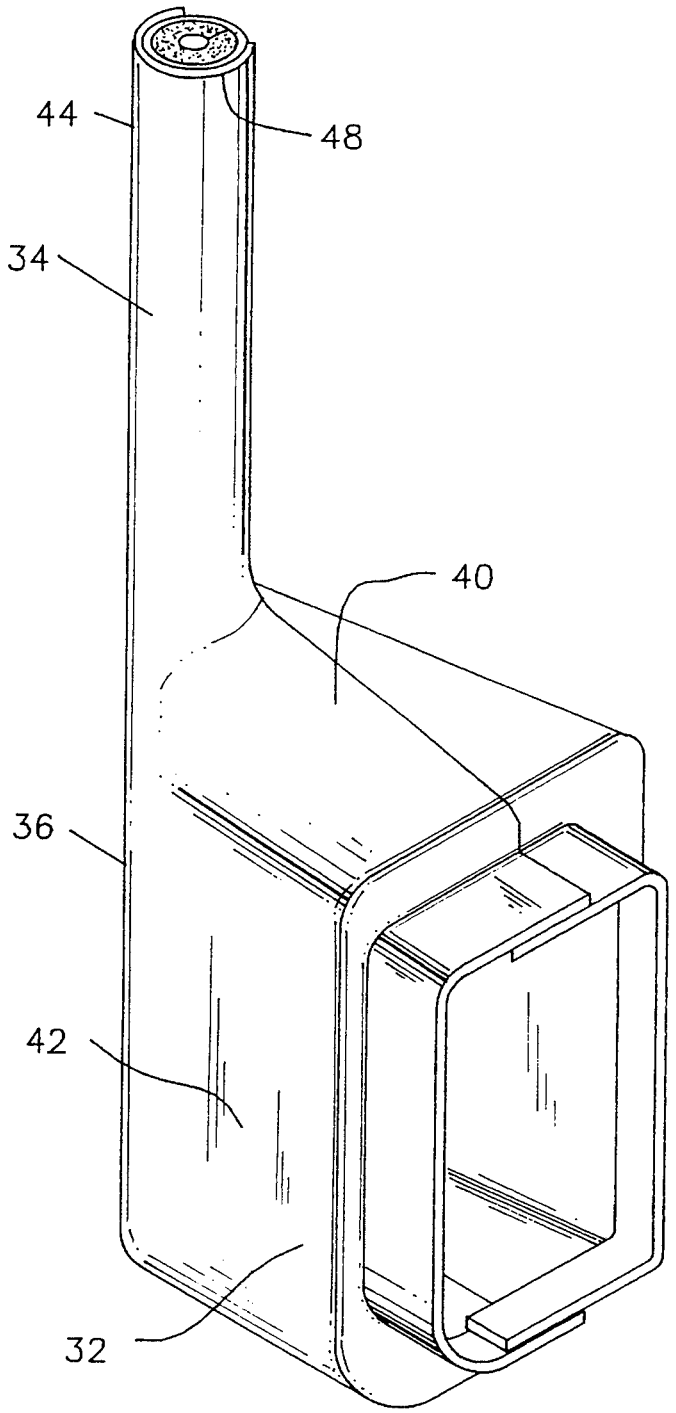
FIG. 7 is a perspective view of the protective cover of FIG. 2 in the non-expanded position.

FIG. 3A shows the cover 20 in a fully closed position, where the left and right portions 28, 30 are in close relation. FIG. 3B shows the cover 20 in an expanded position, where the left and right portions 28, 30 are in a relatively distant relation, the wedge is fully expanded, and the housing 22 can accommodate a larger P-shaped trap or a P-shaped trap installed at an oblique angle.

Once the left and right portions 28, 30 have been sheathed and secured around the drain pipe 2 and the P-shaped trap section 3, any convenient means can be employed to more permanently secure the portions 28, 30 in the desired position. For example, PVC tape can be wrapped around the upper section 26, thus preventing slippage of the portions 28 and 30. Other means, such as rivets, screws, clamps and the like may also be employed.

The left and right portions 28, 30 are of unitary construction, and can be fabricated from any conventional process. When plastic is used as the stock material, fabrication can be effected by stretch forming, injection molding, blow molding, thermoforming, spray molding, or reaction injection molding, all of which are methods well known in the art.

The protective cover 20 can optionally comprise a cylindrical sleeve 50 of insulating material, such as fiberglass or soft urethane, disposed between the outside of the vertical drain pipe 2 and the inside of the vertically disposed cylindrical upper section 26. A longitudinal split extends through the sleeve 50 to facilitate installation over the drain pipe 2.

Practice has taught that in order to achieve the desired flexibility and resiliency of the PVC to be used to fabricate the portions 28, 30, such portions should be approximately 0.030 inches to 0.065 inches thick.

Practice has also taught that the most common P-shaped trap installation consists of a $1\frac{1}{4}''$ plastic P-shaped trap. In practice, we used a $1\frac{3}{8}''$ I.D. sponge plastic pipe insulation that is $\frac{1}{2}''$ thick, resulting in a pipe installation that is $2\frac{3}{8}''$ O.D. The PVC cover was made to a 3" O.D. dimension. When the sponge plastic pipe insulation was spread open to go over screwed coupling and any other protuberances, it became slightly larger than 3" O.D. We compressed the cover onto the resilient pipe insulation, and taped it tight, causing a rugged, rigid, white high gloss structure that is pleasing in appearance.

The vertical length of this unit can be made 12" or longer, although a common required length would be 8" to 9" long, and can be trimmed to the proper length as required. This expandable configuration contains enough area to encompass almost all of the common variations that are encountered by offsets, without adhering extra pieces to the original part. This configuration can be spread between about 22° to 90° to keep knees away from almost all configurations encountered with P-shaped trap connections.

Figure 8:
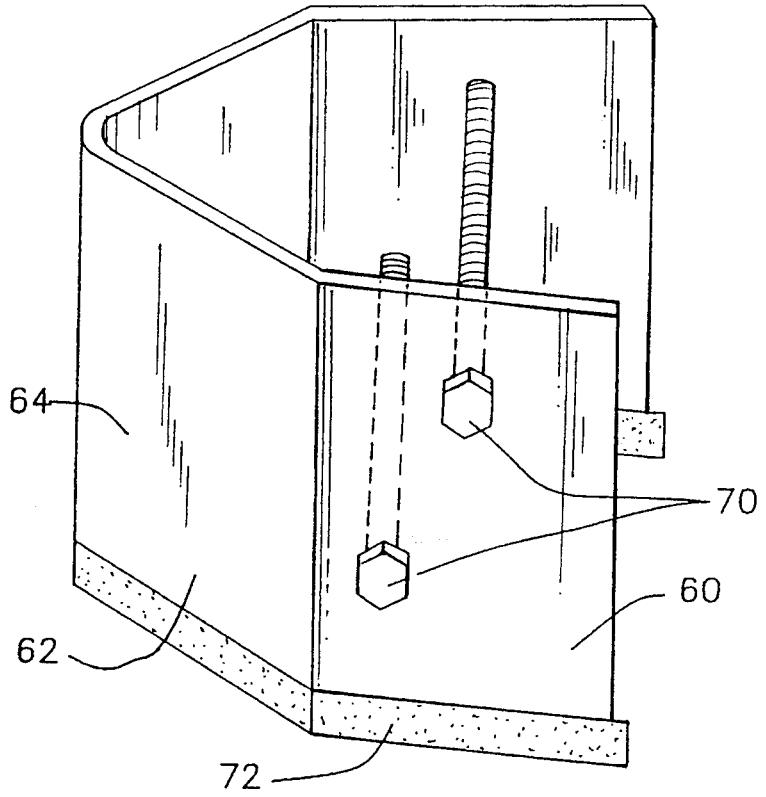
FIG. 8 is a perspective view of a one-piece alternative embodiment P-shaped trap protective cover.
Figure 9:
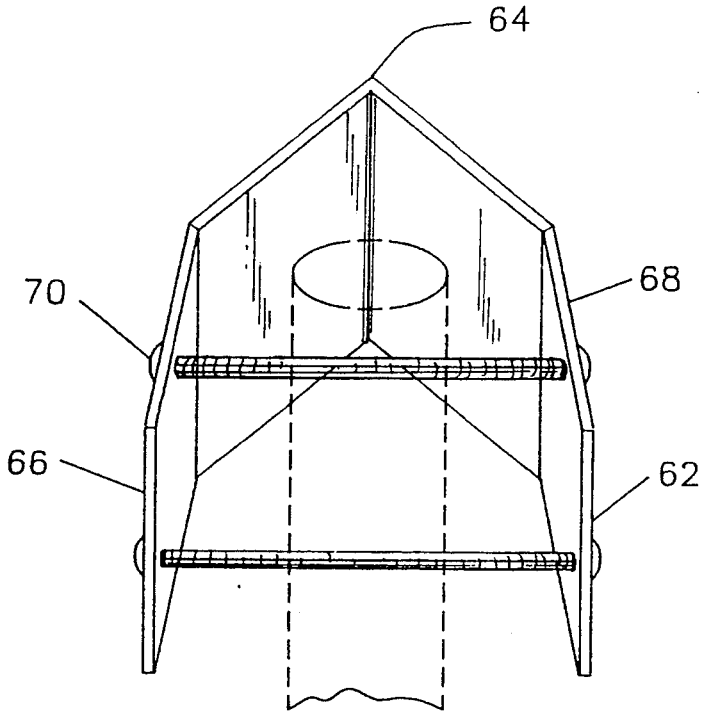
FIG. 9 is a top view of the protective cover of FIG. 8.

A one-piece protective cover 60, which is a further preferred embodiment of the present invention, is shown in FIGS. 8 and 9. The protective cover 60 comprises a shield 62 for substantially surrounding the front and sides of the P-shaped trap section 3. The shield 62 has a curved front section 64, which in the preferred embodiment is wedge-shaped, or can optionally be U-shaped. Adjoining the front 64 is a left side 66 and a right side 68, which both extend rearwardly past the P-shaped trap section 3.

The shield 62 is fabricated from a rigid thermoplastic, although it can also be made from stainless steel or aluminum. The shield 62 need be only slightly flexible in order to allow it to be spread during installation. Practice has taught that the shield should be approximately 1/16 inches thick in order to achieve the desired rigidity and slight flexibility for installation.

The cover 60 also has means for attaching the shield 62 around the P-shaped trap section 3, which in the preferred embodiment are a pair of bolts 70 which extend through the sides 66, 68. Preferably, the shield 62 is positioned so as to be at least approximately one-quarter inch away from the vertical front leg 4 of the P-shaped trap section 3.

The curved front section 64 of the shield 62 acts to deflect the legs of the wheelchair bound person apart from each other and around the P-shaped trap so as to prevent burning or other injury. The sides 66, 68 likewise prevent the legs from coming into contact with the sides of the P-shaped trap section 3.

The protective cover 60 optionally comprises means for cushioning the lower edges of the shield 62 from the legs of the wheelchair bound person, such as edge guards 72 which can be pushed over the potentially sharp edges of the shield 62.

The protective cover 60 can be implemented with any of a variety of sizes of P-shaped traps, and those which have been installed at a variety of angles. No adjustment, trimming or other alterations are needed in order to implement this cover 60 in any such application. A standard length of 12 inches (±2") is used to cover virtually all installation applications without the need for on or off site customization. The cover 60 can be installed very quickly, i.e. in a number of seconds, thus lowering considerably the cost of installation.

Figure 10:
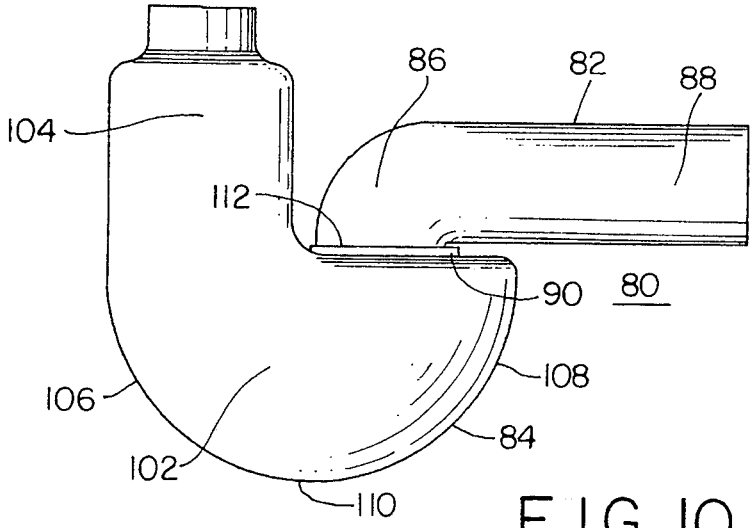
FIG. 10 is a side view of the cover of another alternative embodiment P-shaped trap protective cover.
Figure 11:
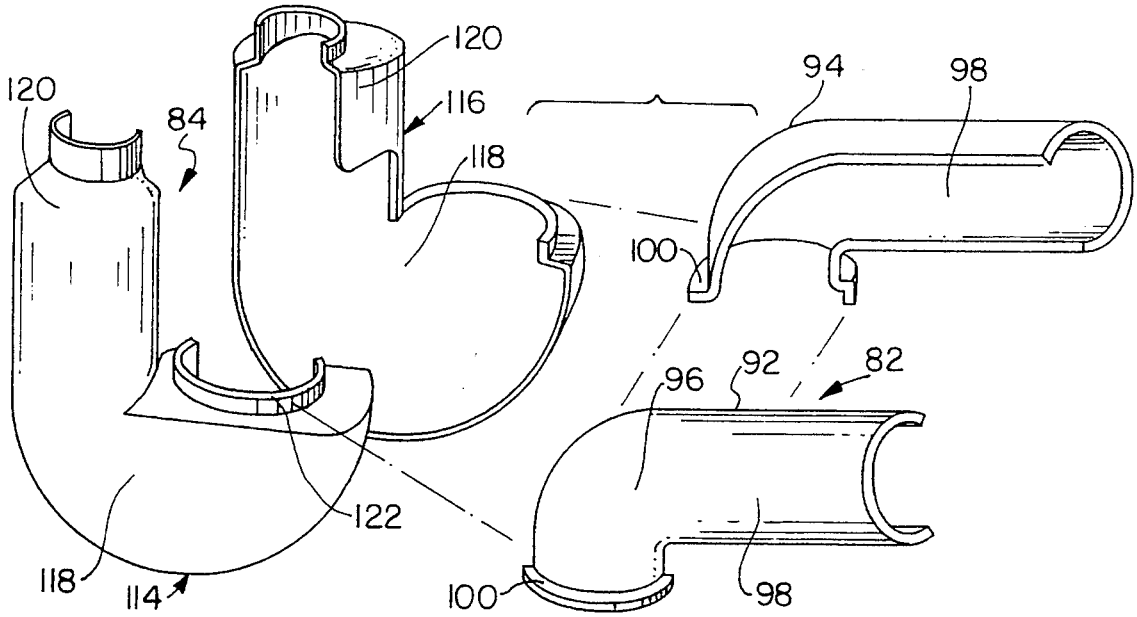
FIG. 11 is an exploded perspective view of the component pieces of the protective cover of FIG. 10.

A further embodiment of the present invention is shown in FIGS. 10 and 11. Illustrated is a protective cover 80, which comprises four pieces to be assembled together during installation at the site. The cover 80 is useful for situations where the elbow 10 and the outlet pipe 12 extend from the P-shaped trap section 3 at an angle, rather than being disposed straight back. In such cases, it is necessary to enclose the entire fixture, rather than just the front and sides (as in the first two embodiments), since the P-shaped trap section 3, elbow 10 and/or outlet pipe 12 extend obliquely and could come into contact with the person's legs.

The cover 80 comprises an elbow covering section 82 for covering the elbow 10 and the outlet pipe 12, and a trap covering section 84 for covering the vertical front leg 4 and the arcuate section 6 of the P-shaped trap section 3.

The elbow covering section 82 comprises an elbow-shaped section 86 conformed to the elbow 10 and integrally connected to a cylindrical section 88 conformed to the outlet pipe 12. The elbow-shaped section 86 has a flange 90 at the end adjoining the trap covering section 84.

The elbow covering section 82 is assembled from a left elbow covering portion 92 and a right elbow covering portion 94, which are oppositely disposed and substantially mirror-image versions of each other. Each of the left and right elbow covering portions 92, 94 comprise a partial elbow-shaped portion 96, a partial cylindrical portion 98 and a partial flange portion 100. The left and right elbow covering portions 92, 94 are fabricated from a resilient thermoplastic, such as PVC, which can be temporarily deformed and, due to its inherent resiliency, will retain through memory and seek to return to its original shape. To install the elbow covering section 82 at the job site, one of the left or right elbow covering portions 92, 94 is partially and temporarily deformed and inserted into the other and around the elbow 10 and outlet pipe 12 such that the elbow 10 and outlet pipe 12 are enclosed thereby.

The trap covering section comprises a trough-shaped section 102 formed integrally with an upper section 104. The trough-shaped section 102 has a front 106, a back 108 and a trough 110 generally curved from front 106 to back 108. The upper section 104 extends from the front 106. The trough-shaped section 102 is sized to conform to the arcuate section 6 of the P-shaped trap section 3. The back 108 of the trough-shaped section 102 has a flange receiving section 112 conformed to capture therein the flange 90 of the elbow covering section 82.

The trap covering section 84 is assembled from a left trap covering portion 114 and a right trap covering portion 116, which are oppositely disposed substantially mirror-image versions of each other. Each of the left and right trap covering portions 114, 116 comprise a partial trough-shaped portion 118, a partial upper section 120 and a partial flange receiving section 122. The left and right trap covering portions 114, 116 are likewise fabricated from a resilient thermoplastic, such as PVC, which can be temporarily deformed and, due to its inherent resiliency, will retain through memory and seek to return to its original shape. Therefore, to install the trap covering section 84 at the job site, one of the left or right trap covering portions 114, 116 is partially and temporarily deformed and inserted into the other and around the P-shaped trap section 3 and vertical drain pipe 2, such that said the flange receiving section 112 captures the flange 90 of the elbow covering section 82 and such that the P-shaped trap section 3 and vertical drain pipe 2 are enclosed thereby.

Thus, the elbow covering section 82 and the trap covering section 84 cooperate to enclose the vertical drain pipe 2, the P-shaped trap section 3, the elbow 10 and the outlet pipe 12. This configuration allows easy installation of the protective cover in situations where the elbow 10 and the outlet pipe 12 extend from the P-shaped trap section 3 at an angle, rather than being disposed straight back. Different installation angles can be accommodated by this configuration since the flange 90 is able to be captured by the flange receiving section 112 at the desired angle.

Any suitable method of manufacture of the four pieces comprising protective cover 80—the left elbow covering portion 92, the right elbow covering portion 94, the left trap covering portion 114 and the right trap covering portion 116—may be employed, such as injection molding, blow molding, thermoforming, spray molding or reaction injection molding.

Practice has taught that in order to achieve the desired flexibility and resiliency of the PVC to be used to fabricate the four pieces comprising protective cover 80, such pieces should be approximately 0.025 inches to 0.045 inches thick.

A cylindrical sleeve 124 of insulating material, such as fiberglass or soft urethane, may optionally be disposed via a longitudinal slit around the vertical drain pipe 2 and within the upper section 104.

The four pieces of the cover 80 interlock with each other and thus hold each other in place. In order to more permanently join the pieces to each other, however, any conventional means known in the art may be employed. Preferably, PVC tape may be used to wrap around those sections or portions which are convenient to the installer.

Figure 12:
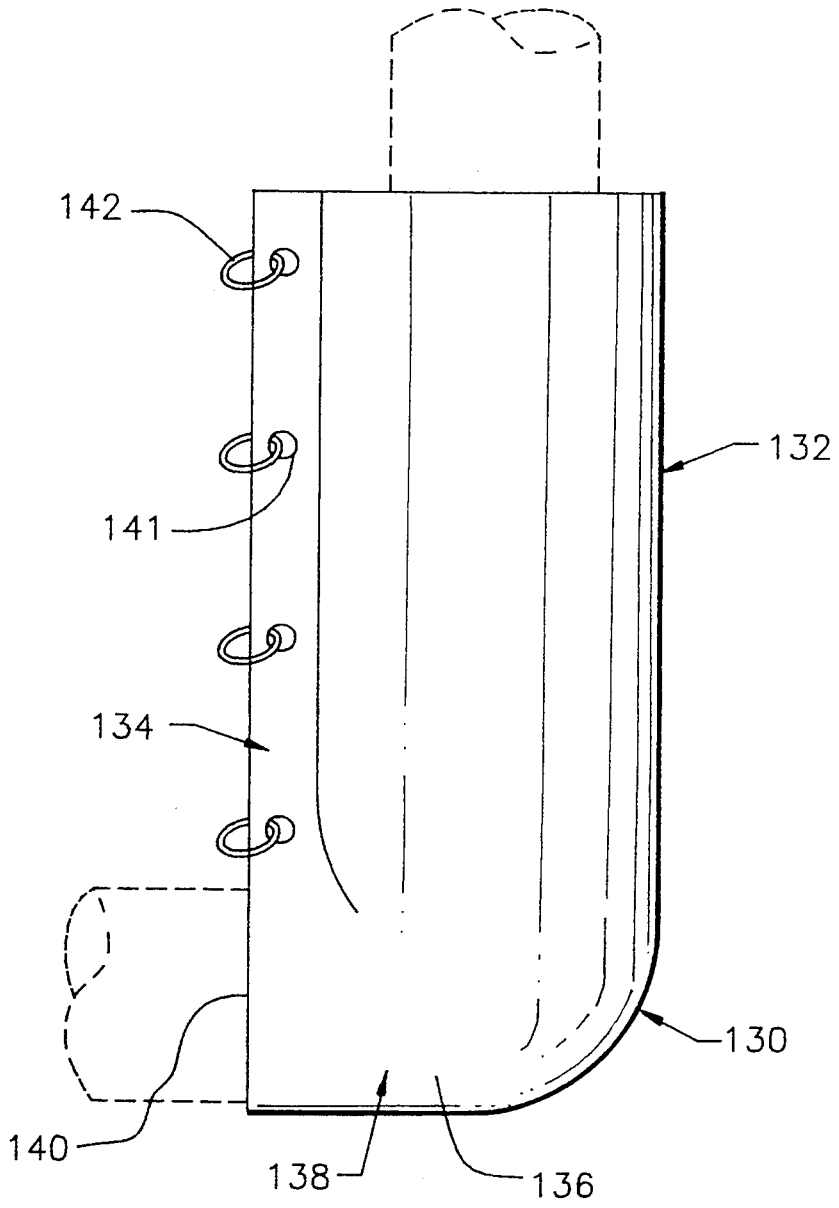
FIG. 12 is a side view of another alternative embodiment P-shaped trap protective cover.
Figure 13:
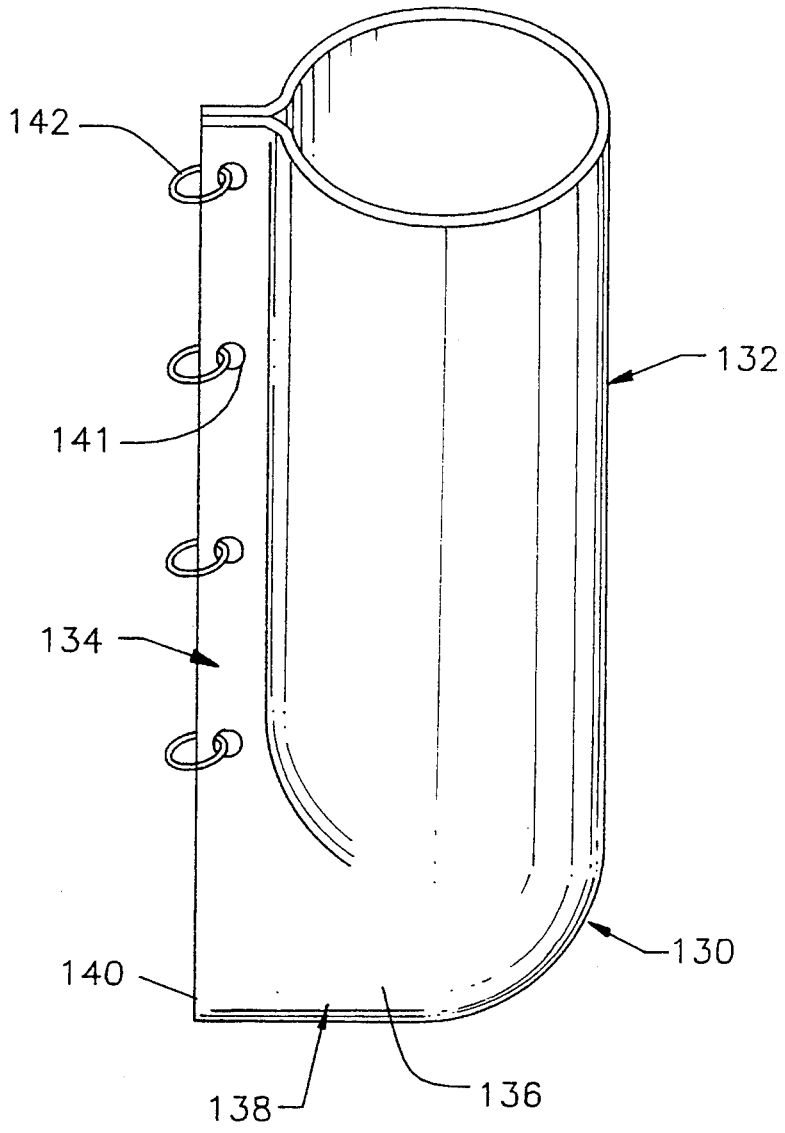
FIG. 13 is a perspective view of the protective cover of FIG. 12.

A further embodiment of the present invention is shown in FIGS. 12 and 13. Shown therein is a one-piece protective cover 130 which can be used when the P-shaped trap section 3 and outlet pipe 12 extend rearwardly in a straight direction, such that only the front portions of the plumbing under the sink, i.e. the vertical drain pipe 2 and the vertical front leg 4 of the P-shaped trap section 3, need to be covered in order to properly protect the legs of the wheelchair bound person since the cover 130 will deflect the knees apart and away from the hot pipes. The protective cover 130 comprises a substantially cylindrical upper section 132 of C-shaped configuration, which has a pair of upper lips 134 extending linearly along its edges.

Integrally connected to the upper section 132 is an elbow section 136. The elbow section 136 has a shoulder 138 at its open end, which has a substantially circular elbow lip 140 integrally connected thereto. The elbow lip 140 is also integrally connected to each of the upper lips 134 so as to form one contiguous lip.

The cover 130 also has a plurality of mating pairs of openings 141 in the upper lips 134 and a plastic beaded cable tie 142 associated with each pair of openings.

The cover 130 is fabricated from a resilient thermoplastic, such as PVC, which can be temporarily deformed and, due to its inherent resiliency, will retain through memory and seek to return to its original shape. Practice has taught that the cover 130 should be fabricated from PVC stock with a thickness of 0.040 inches to 0.055 inches in order to achieve the desired properties.

The cover 130 is installed by sheathing the elbow section 136 substantially around the vertical front leg 4 and substantially around part of the arcuate section 6 of the P-shaped trap section 3 and also by sheathing the upper section 132 substantially around the vertical drain pipe 2. The upper lips 134 are joined towards each other with and fastened by the cable ties 142. Thus, the curved front portion of the protective cover 130 acts to deflect the legs of the wheelchair bound person apart from each other and around the P-shaped trap so as to prevent burning or other injury.

An alternative to using cable ties is to wrap the cover 130 with PVC tape, or metal nuts and bolts can be used.

Optionally, a cylindrical sleeve of insulating material, such as fiberglass or soft urethane, may be inserted onto the vertical drain pipe 2 via a longitudinal slit prior to installing the cover 130.

The protective cover 130 is marketed under the trade name HPT-GARD by Proto Corp. Practice has taught that the cover 130 can be installed in five minutes, as opposed to thirty minutes for prior art covers. The HPT-GARD made by Proto Corp. is very rigid and made of high gloss rugged LOSMOKE® PVC. It is more safety effective than previous methods, and easy to keep clean.

Figure 14:
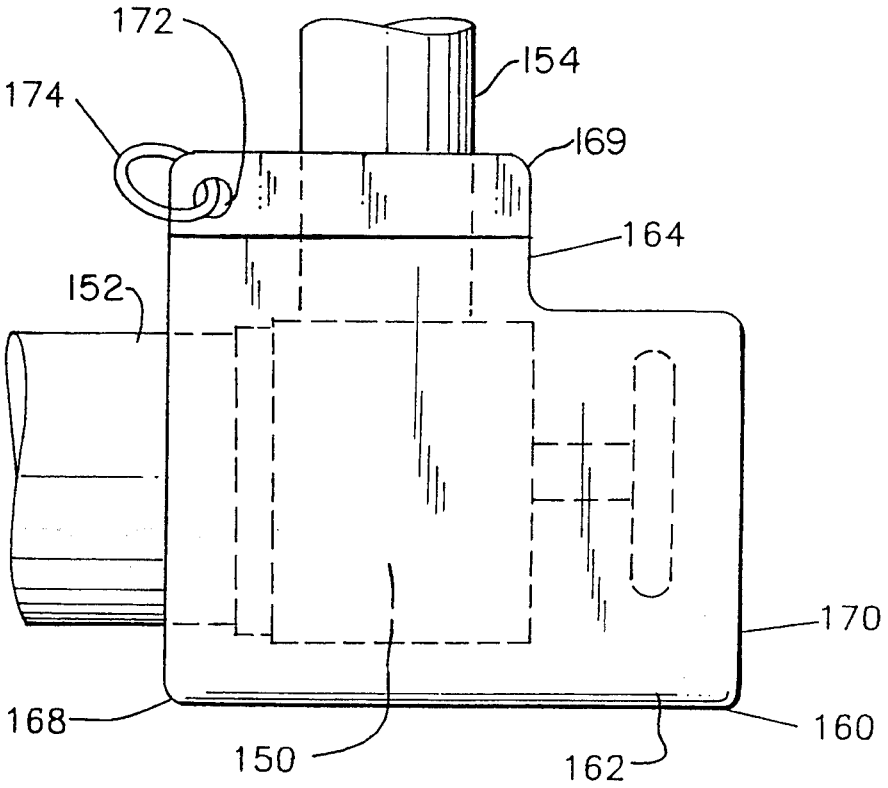
FIG. 14 is a side view of a preferred embodiment of a water supply valve protective cover of the present invention.
Figure 15:
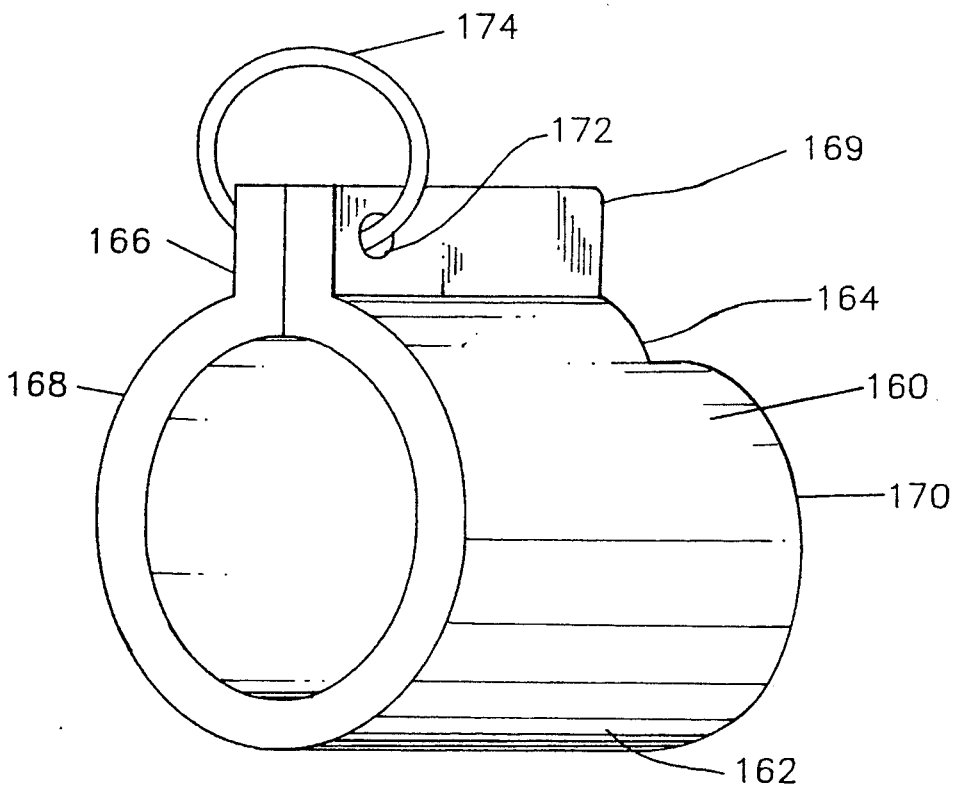
FIG. 15 is a perspective view of the valve protective cover of FIG. 14.

The following descriptions of the preferred embodiments of the water supply valve protective covers of the present invention are made with reference to the water supply valve 150 shown in FIG. 14 having an inlet pipe 152 extending rearwardly therefrom and an outlet pipe 154 extending vertically.

The water supply valve protective cover 160 shown in FIG. 14 comprises a substantially cup-shaped member 162 sized to fit around the valve 150. The cup-shaped member 162 comprises along its circumference an integrally connected pipe fitting 164. The pipe fitting 164 is substantially U-shaped with an open end 166 facing the rear 168 of the cup-shaped member 162 and an arcuate end 169 facing the front 170 of the cup-shaped member 162. The pipe fitting comprises a pair of openings 172 and a plastic beaded cable tie 174 for encasing the outlet pipe 154 within and securing the cover 160 onto the valve 150 as desired.

Optionally, an insulating member may be disposed within the cover 160 prior to installation. The insulating member 176 may be, for example, fiberglass or soft urethane.

Figure 16:
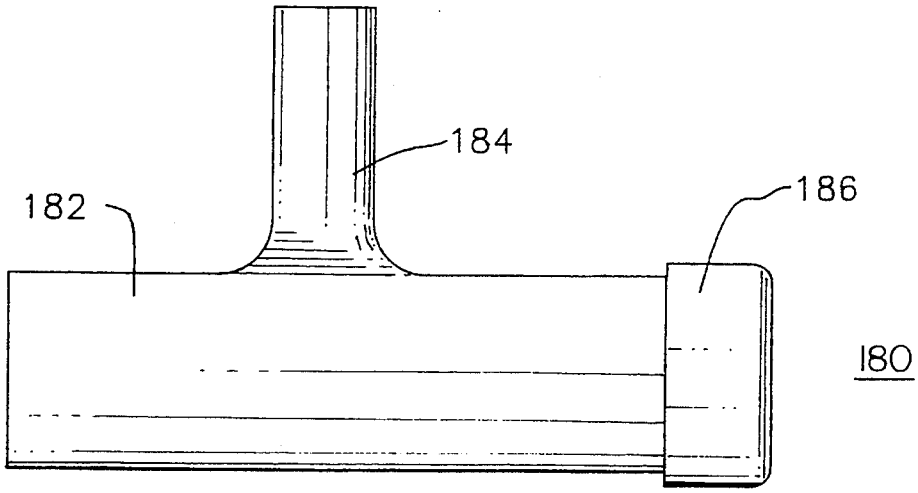
FIG. 16 is a side view of an alternative embodiment water supply valve protective cover.
Figure 17:
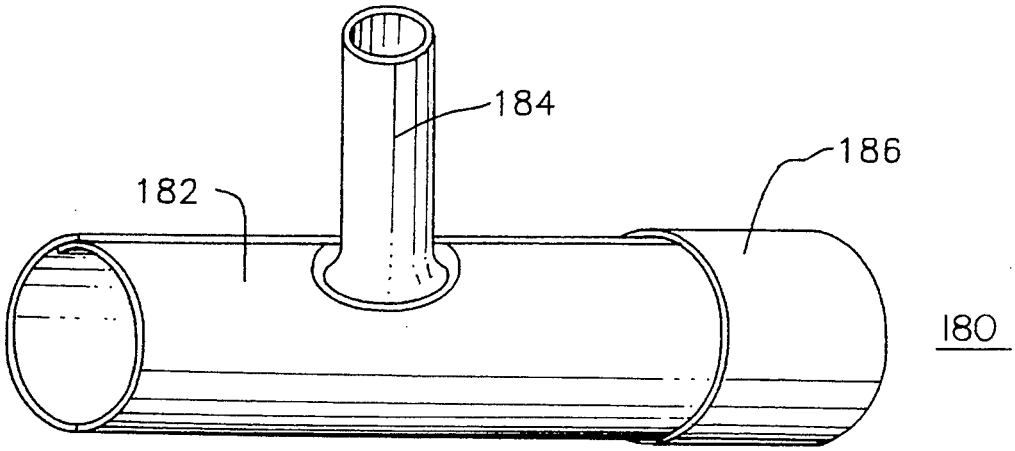
FIG. 17 is a perspective view of the valve protective cover of FIG. 16.
Figure 18:
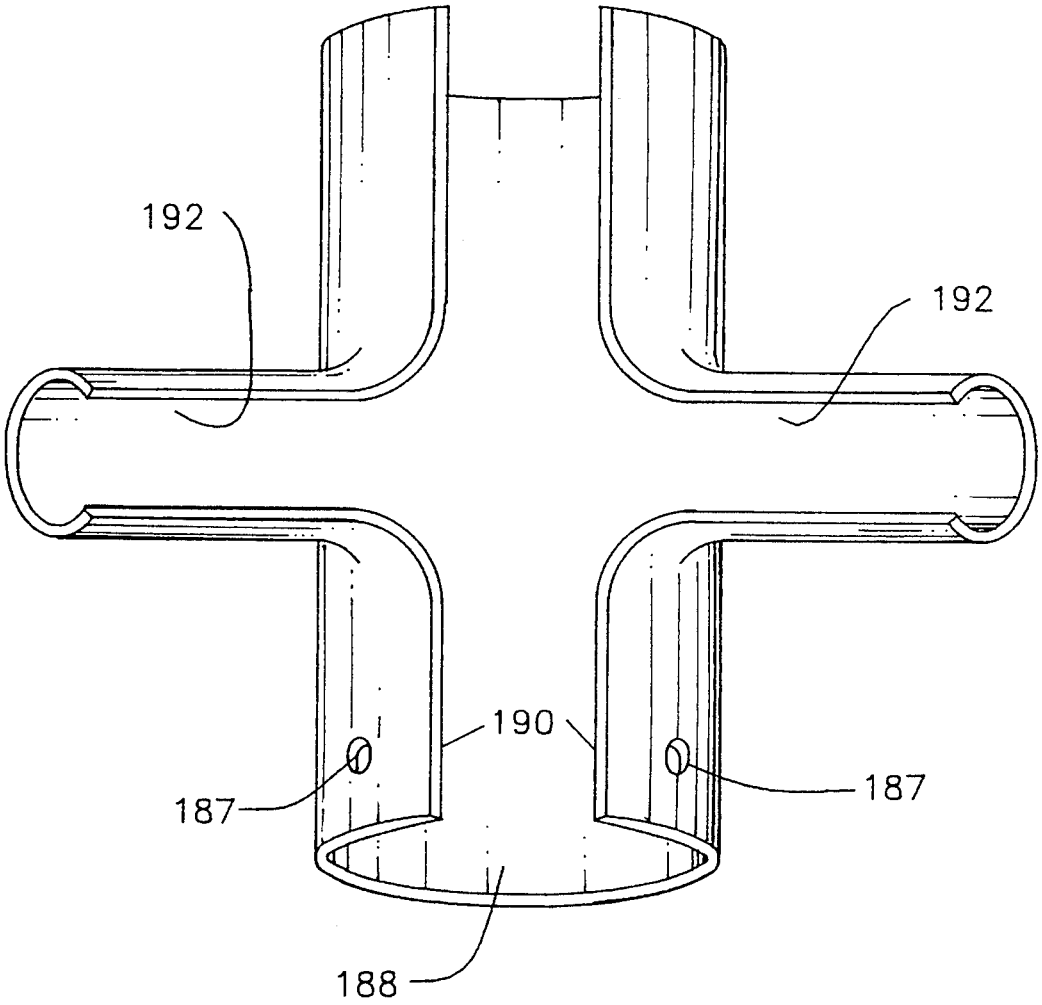
FIG. 18 is a perspective view of the valve protective cover of FIG. 16 in unassembled form.

A second valve protective cover 180 is shown in FIGS. 16–18. The protective cover 180 comprises a major cylindrical section 182 being sized to horizontally encase the valve 150 and a minor cylindrical section 184 being sized to vertically encase outlet pipe 154. The minor cylindrical section 184 intersects the major cylindrical section 182 so as to form a substantially inverted T-shaped configuration.

The cover 180 also has an end cap 186 being sized to fit snugly over the end of the major cylindrical section 182, which cap 186 can be removed to turn the valve 150 on or off as desired without having to remove the installed cover 180.

The cover 180 is a unitary flexible piece of resilient thermoplastic, such as PVC, which can be temporarily deformed and, due to its inherent resiliency, will retain through memory and seek to return to its original shape. The cover 180 comprises a major substantially C-shaped elongated member 188 which has a pair of edges 190. Extending from each of the edges 190 and integrally connected thereto is a pair of minor substantially C-shaped members 192. Upon enclosing the major C-shaped member 188 around the inlet pipe 152 and the valve 150, one of the minor members 192 can be partially and temporarily deformed and snugly inserted in opposed fashion into the other minor member 192, thus forming the major cylindrical section 182 and the minor cylindrical section 184 and enclosing the outlet pipe 154. Although the resiliency of the PVC urges the cover 180 to interlock and thus retain its assembled shape, the cover 180 can be more permanently held in place by wrapping PVC tape around the major cylindrical section 182 and/or the minor cylindrical section 184.

The major cylindrical section 182 comprises a pair of protruding dimples 187 at the end which houses the end cap 186. The end cap 186 is inserted onto the cover 180 and releasably held in place by the dimples 187.

Practice has taught that the cover 180 should be fabricated from PVC stock with a thickness of 0.025 inches in order to achieve the desired properties.

The protective cover 180 is marketed under the trade name HV-GARD by Proto Corp.

I claim:

1. A protective cover for an exposed horizontally disposed P-shaped sink trap, said sink trap having a vertical drain pipe connected to and extending downwardly from a sink drain outlet and a horizontally disposed P-shaped trap section having a vertical front leg connected to said vertical drain pipe, an arcuate section extending rearwardly therefrom to a vertical back leg connected to an elbow, and an outlet pipe extending from said elbow, for protecting a wheelchair bound person from burning when using the sink, said protective sink trap cover comprising:

an expandable housing for substantially enclosing said P-shaped trap section, said housing having a front section and a vertically disposed upper section for substantially enclosing said vertical drain pipe, said housing being comprised of a pair of oppositely disposed substantially mirror-image portions comprising a left portion and a right portion, each of said left and right portions comprising a partial housing portion including said front section and a partial upper section portion;

whereby, by partially and temporarily deforming and inserting one of said left or right portions into the other said left or right portion and disposing said portion around the vertical drain pipe and the P-shaped trap section, the left and right portions are rotatable relative to each other around an axis extending vertically through the center of the upper section, and the volume of space inside the housing can be enlarged or reduced to accommodate a variety of sizes of P-shaped traps and a variety of angles of installation of P-shaped traps.

2. A protective cover for an exposed horizontally disposed P-shaped sink trap, said sink trap having a vertical drain pipe connected to and extending downwardly from a sink drain outlet and a horizontally disposed P-shaped trap section having a vertical front leg connected to said vertical drain pipe, an arcuate section extending rearwardly therefrom to a vertical back leg connected to an elbow, and an outlet pipe extending from said elbow, for protecting a wheelchair bound person from burning when using the sink, said protective sink trap cover comprising:

an expandable housing for substantially enclosing said P-shaped trap section, said housing having a curved front section and an open rear, said housing further having a vertically disposed cylindrical upper section for substantially enclosing said vertical drain pipe, said housing being substantially wedge shaped from said front section to said rear, said housing being comprised of a pair of oppositely disposed substantially mirror-image portions comprising a left portion and a right portion, each of said left and right portions comprising a partial housing portion including said front section and said rear and a partial upper section portion including said cylindrical upper section, said partial housing portion comprising a curved front, a bottom, a top and a side, said partial upper section comprising a curved front and a curved rear joined by a curved side formed in a C-shaped substantially cylindrical configuration;

whereby, by partially and temporarily deforming and inserting one of said left or right portions into the other said left or right portion and disposing said portions around the vertical drain pipe and the P-shaped trap section, the curved fronts of the partial upper sections overlap and the curved rears of the partial upper sections overlap and thereby surround the vertical drain pipe, and the curved front sections of the partial housing portions overlap, the bottom sections of the partial housing portions overlap, and the top sections of the partial housing portions overlap and thereby substantially surround the P-shaped trap section with the outlet pipe extending from and out of the rear opening, and such that the left and right portions are rotatable relative to each other around an axis extending vertically through the center of the upper section, the rear opening can be enlarged or reduced and the volume of space inside the housing can be accordingly enlarged or reduced to accommodate a variety of sizes of P-shaped traps and a variety of angles of installation of P-shaped traps, and the substantially wedge-shaped housing acts to deflect the legs of the wheelchair bound person apart from each other and around the P-shaped trap so as to prevent burning or other injury.

3. The protective cover of claim 2 in which the left portion and the right portion are made of resilient thermoformed PVC.

4. The protective cover of claim 3 in which the left portion and the right portion are fabricated by injection molding, blow molding, thermoforming, spray molding or reaction injection molding.

5. The protective cover of claim 4 further comprising a cylindrical sleeve of insulating material disposed between the outside of the vertical drain pipe and the inside of the vertically disposed cylindrical upper section.

6. The protective cover of claim 5 further comprising means for attaching said left and right portions to each other and around the vertical drain pipe and the P-shaped trap section.

7. The protective cover of claim 6 in which said attachment means comprises PVC tape.

* * * * *